US009394704B2

(12) United States Patent
Martinez

(10) Patent No.: US 9,394,704 B2
(45) Date of Patent: Jul. 19, 2016

(54) FLOORING SPLICER

(71) Applicant: Leo Martinez, Buena Park, CA (US)

(72) Inventor: Leo Martinez, Buena Park, CA (US)

( * ) Notice: Subject to any disclaimer, the term of this patent is extended or adjusted under 35 U.S.C. 154(b) by 144 days.

(21) Appl. No.: 13/998,876

(22) Filed: Dec. 17, 2013

(65) Prior Publication Data

US 2015/0167324 A1 Jun. 18, 2015

(51) Int. Cl.

| | |
|---|---|
| ***B26B 27/00*** | (2006.01) |
| ***E04F 21/24*** | (2006.01) |
| ***B26B 5/00*** | (2006.01) |
| ***B27G 17/04*** | (2006.01) |

(52) U.S. Cl.

CPC ..... *E04F 21/24* (2013.01); *B26B 5/005* (2013.01); *B27G 17/04* (2013.01)

(58) Field of Classification Search

CPC ..... B26B 5/005; B27G 17/04; E04F 21/24
USPC ..... 30/294, 356, 314, 289, 290, 291, 293, 30/DIG. 8

See application file for complete search history.

(56) References Cited

U.S. PATENT DOCUMENTS

| | | | | |
|---|---|---|---|---|
| 4,813,141 | A * | 3/1989 | Funger | 30/290 |
| 5,656,126 | A | 8/1997 | Martinez | |
| 6,112,417 | A * | 9/2000 | Hyer et al. | 30/290 |
| 6,640,446 | B2 | 11/2003 | Martinez | |
| 6,647,628 | B1 * | 11/2003 | Braaksma | 30/294 |
| 6,871,013 | B2 | 3/2005 | Martinez | |
| 8,650,760 | B2 * | 2/2014 | Van Alstine | 30/140 |

OTHER PUBLICATIONS

Turbo Heat Welding Tools Catalog, pp. 1-7, p. 7, Jun. 2013.
Turbo Cove Groover, User Guide Feb. 20, 2007.
Janser Catalog 105E, Grooving Tools,pp. 26-27;Hot Air Weld Guns, pp. 28-30; Welding Equipment, p. 30 circa 2005.
Crain Catalog 2011, Other Vinyl tools, Skiving Knife; Replacement Blade, p. 26, 2011.
Profloor Main Catalog(Hauptkatalog),item 61900 00 Reparatur-set p. 2.33, 2006.
Sinclair Equipment Company. Catalog, Hand Tools, pp. 7-8; 2012.
National Flooring Equipment Catalo#11-1, Heat Welding Accessories, Mozart Trimming Knife, p. 9, 2012.
National Flooring Equipment Catalo#11-13, Mozart Trimming Knife, p. 4, 2012.
N.I.T. Installation School catalog, Tools and Accessories for Floor Coverings, item M115 p. 32, 2012.

* cited by examiner

*Primary Examiner* — Omar Flores Sanchez
(74) *Attorney, Agent, or Firm* — Charles H. Thomas

(57) ABSTRACT

A floor laying tool allows a flooring installer to create splices between longitudinally overlapping beads of sealant where sheets of flooring are laid down in abutting relationship. The floor laying tool has a base structure with a flat bottom, a front end and a rear end. The rear end is hollow to accommodate a carriage that moves in a reciprocal, longitudinal path along inclined tracks on the base structure. The carriage carries a blade. When the tool is positioned over the end of a bead of sealant lying in a groove where the flooring edges abut, the carriage is moved forward while the base is held stationary. The carriage is moved up the inclined tracks, and travels along an inclined path to remove an elongated slice from the upwardly facing portion of the end of the bead of sealant. A subsequent bead of sealant laid in longitudinally overlapping fashion is joined in a splice that is nearly invisible in the finished product.

12 Claims, 8 Drawing Sheets

FLOORING SPLICER

BACKGROUND OF THE INVENTION

1. Field of the Invention

The present invention relates to a tool useful for forming splices between longitudinally successive beads of adhesive in seams between adjacent sheets of flooring.

2. Description of the Prior Art

In laying sheets of flooring, such as linoleum, it is common practice to join adjacent sheets of flooring using beads of adhesive laid down in grooves formed at the abutting edges of adjacent sheets of flooring. The beads of adhesive are formed by melting thermoplastic adhesive rods using a seam sealing welding gun or tool. The rods are fed into a welding rod receiving tube of a hollow heating nozzle or tip mounted on the front end of a handheld seam sealant adhesive welding gun. The extremity of the welding rod closest to the flooring is melted in the melting chamber of the heating nozzle and flows into a groove or channel previously formed along the abutting edges of two adjacent sheets of flooring. As the adhesive welding gun is moved past the adhesive dispensed into the groove the adhesive hardens and joins the edges of the abutting sheets of flooring together. This process, and certain tools for performing it, are described in greater detail in U.S. Pat. Nos. 5,656,126; 6,640,446; and 6,871,013, all of which are hereby incorporated by reference in their entireties.

The sticks of adhesive rods used in this process are typically about 12 to 18 inches in length. While the adhesive is often sold in continuous rolls, it is not practical to seal adjacent sheets of flooring with a single continuous bead dispensed in a single pass along the entire length of the seam. This is impossible because the installer must interrupt the seam sealing process in order to establish a better position for holding the seam sealing gun as the installer moves along the length of the seam. Consequently, the beads of sealant in a long seam cannot be formed from a single, continuous length of sealant material. Rather they are formed of sections of the adhesive rod spliced together at longitudinal intervals along the length of the seam. Typically an installer will be able to lay continuous beads of sealant into a groove at the interface between adjacent sheets of flooring a maximum of about 36 inches before terminating the section of sealant laid and lifting the seam sealing tool from the floor. For a 12 foot room this means there will be at least three splices along the length of the seam.

As the installer forms the splice or transition from one length of a section of sealant to the next, the end of the length of sealant bead last laid down has typically cooled before the melted adhesive from the next stick of adhesive is laid on top of it. As a result, there is a visible demarcation between the ends of the sequential lengths of adhesive, even though the splice between them is physically secure.

To reduce the visibility of the transition between sequential lengths of adhesive, an installer will sometimes use a narrow chisel like hand tool to attempt to create an inclined slope on the end of the bead of the adhesive already laid down. While the creation of such an incline in the length of the adhesive lying in the groove between the adjacent sheets of flooring does result in a reduced visibility of the splices if expertly done, the process is both tedious and difficult to perform without damaging the edges of the adjacent sheets of flooring.

Whether or not the installer attempts to reduce the visibility of the splices between sequentially joined lengths of adhesive bead, a portion of the bead protrudes above the level of the flooring sheets once the seam is completed. This upwardly projecting portion of the bead of sealant is removed in a subsequent process called "skiving". Skiving can be performed with a conventional skiving knife or other tool that removes the part of the bead lying above the plane of the adjacent flooring sheets. The top of the portion of the adhesive bead joining the sheets of flooring that remains in the groove then resides in coplanar relationship with the adjacent sheets of flooring that the seam joins together.

One primary object of the present invention is to provide a tool that is able to quickly, reliably and easily create a slope on the end of a congealed bead of sealant laid into a groove at a seam between adjacent sheets of flooring seam so as to reduce the visibility of a splice subsequently formed with the next sequential length of sealant.

Another object of the invention is to provide a tool that shaves and tapers the end of a length of solidified sealant lying in a groove formed between adjacent sheets of flooring without damaging the abutting edges of the flooring to be sealed together.

A further object of the invention is to provide a tool that shaves the end of a length of solidified sealant lying in a groove formed at the abutting edges of adjacent sheets of flooring upwardly and at an inclination. Such a tapered, inclined surface allows the installer to create a splice that is both stronger, due to the increased area of surface contact between the sequential lengths, and less visible after the skiving operation is completed.

Still a further object of the invention is to provide a tool for creating an inclined splicing surface at the end of an adhesive bead in a groove between abutting sheets of flooring that may be easily aligned with the end of the next bead section.

SUMMARY OF THE INVENTION

In one broad aspect the present invention may be considered to be a floor laying tool comprised of a base, a carriage and a blade. The base has a structure with a flat bottom surface, a front end and a rear end. The rear end is hollow and defines a carriage cavity with an open top and an open bottom. The structure of the rear end defines a pair of longitudinally oriented, mutually parallel tracks with front and rear limiting abutments. The tracks are located on opposing sides of the carriage cavity. The tracks extend forwardly and upwardly toward the front end of the base between the limiting abutments. The carriage is mounted in the carriage cavity and on the tracks for reciprocal, longitudinal movement along the tracks relative to the base between extreme forward and rearward positions as defined by the limiting abutments. The blade is secured to the carriage and has a narrow front cutting end directed toward the front end of the structure.

In another broad aspect the invention may be considered to be a floor laying tool for use in joining abutting sheets of flooring together. The tool is comprised of a body structure, a pair of tracks, a blade carrier and a blade. The body structure has a flat bottom surface formed with front and rear ends, wherein the rear end is hollow with an open top and an open bottom. The rear end has longitudinally oriented, mutually parallel sides. The tracks are provided with both fore and aft limiting elements. These limiting elements are defined in the sides. The tracks are inclined upwardly and forwardly toward the front end of the body. The blade carrier is mounted on the body structure between the mutually parallel sides for reciprocal movement between extreme forward and extreme rearward positions as determined respectively by the fore and aft limiting elements. The blade is secured to the blade carrier and has a narrow front slicing tip. When the blade carrier is in the extreme rearward position the blade tip resides beneath the flat bottom surface of the body structure. When the blade carrier is in the extreme forward position the blade tip resides above the flat bottom surface of the body.

In still another broad aspect the invention may be considered to be a floor laying tool comprising an elongated body, a pair of parallel tracks, a blade carrier and a blade. The body has a structure defining a flat bottom surface, a front end and a rear end. The rear end of the structure has a longitudinally elongated cavity defined therein. The structure of the body has a top and a bottom, both of which are open at the cavity at the rear end of the structure. The structure has longitudinally extending sides at the rear end thereof between which the cavity is located. The pair of parallel tracks have longitudinal limits formed on the sides of the rear end. The tracks extend longitudinally upwardly and forwardly at an inclination relative to the flat bottom surface of the structure toward the front end of the structure. The blade carrier is mounted in the cavity of the rear end of the structure for reciprocal movement along the tracks between extreme rearward and extreme forward positions defined by the longitudinal limits. The blade is secured to the blade carrier and has a forwardly directed slicing tip that is located beneath the flat bottom surface of the structure when the blade carrier is at the extreme rearward position.

The invention may be described with greater clarity and particularity by reference to the accompanying drawings.

DESCRIPTION OF THE EMBODIMENT

Figure 1:
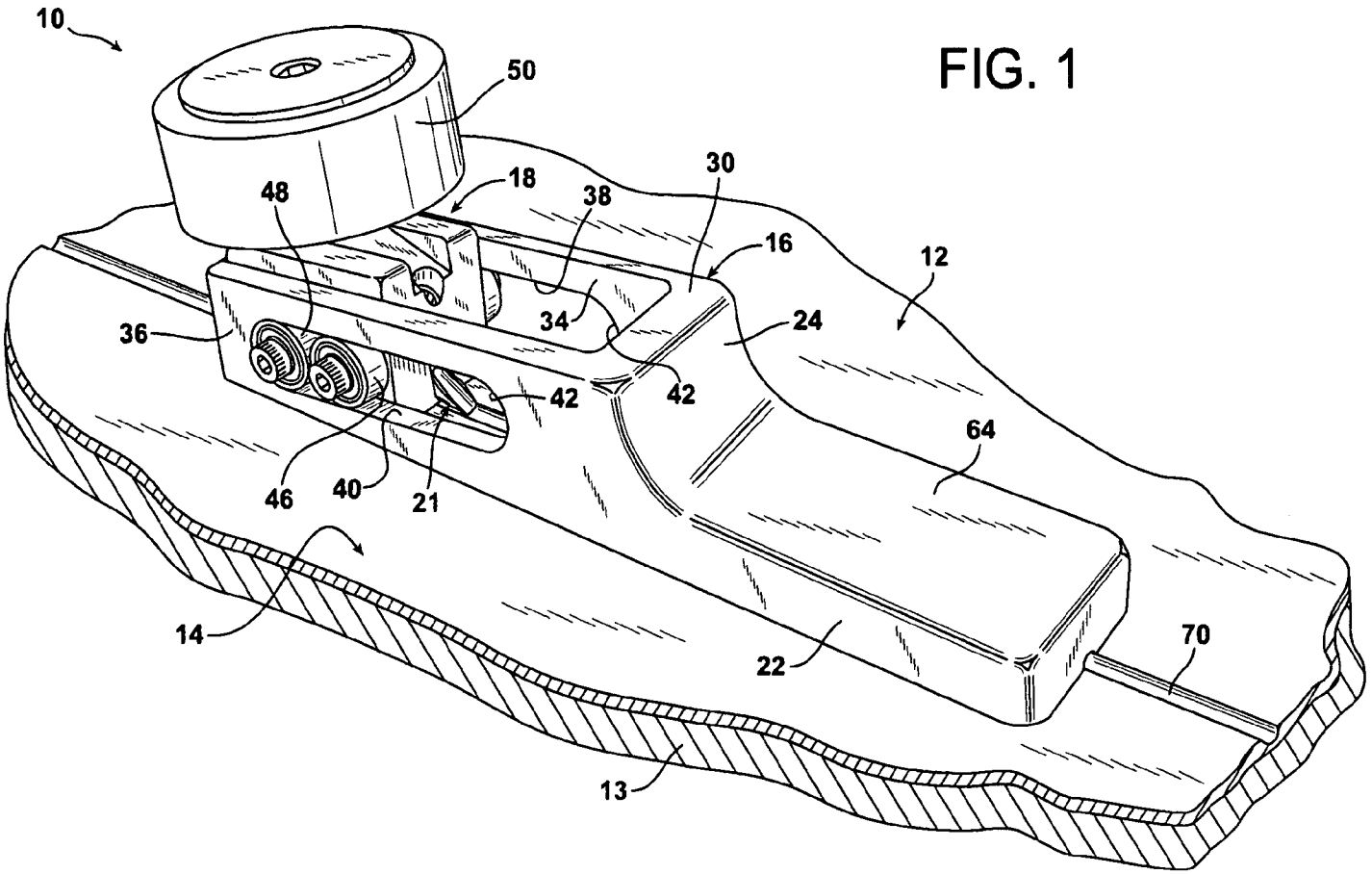
FIG. 1 is a perspective view of a preferred embodiment of the invention.
Figure 9:
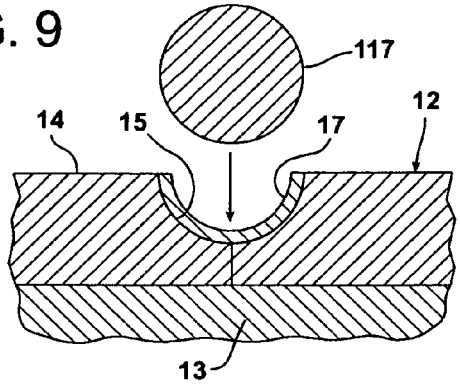
FIG. 9 is an exploded cross-sectional view showing an end of a second, subsequent bead of adhesive laid in the sliced end of the first bead of adhesive shown in FIG. 8.

FIG. 1 illustrates a floor laying tool 10 constructed according to the invention. The floor laying tool 10 is designed for use in joining adjacent sheets of flooring indicated at 12 and 14. The flooring sheets 12 and 14 are laid atop a subfloor 13 and are secured thereto by adhesive in a conventional manner. The edges of the flooring sheets 12 and 14 reside in abutting relationship, as shown in the cross-sectional view of FIG. 9.

As in conventional practice, the sheets of flooring 12 and 14 are first secured to a subfloor 13 by means of an adhesive therebetween. A groove 15 of semicircular configuration is then formed in the upper surface of the sheets of flooring 12 and 14 at their abutting edges, as described in U.S. Pat. No. 6,640,446. The bead of sealant 17 is then laid down in that groove as described in prior U.S. Pat. No. 5,656,126. As the bead of sealant is laid down it adheres to the grooved out surfaces of both the sheets of flooring 12 and 14, but projects upwardly from the groove 15, above the flat upwardly facing surfaces of the sheets of flooring 12 and 14. The sealant bead 17 resides in the semicircular groove 15 defined at the interface between the sheets of flooring 12 and 14 and bonds their edges together.

Figure 14:
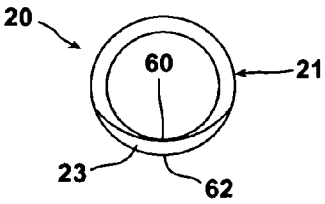
FIG. 14 is an end view of the blade of the invention taken along the lines 14-14 in FIG. 13.

The floor laying tool 10 of the invention is comprised of a base 16, a carriage 18, and a blade 20 secured to the carriage 18. The blade 20 is secured to the carriage 18 and has a narrow forwardly directed slicing tip 21 with a forwardly directed front cutting end 23. The cutting end 23 of the slicing tip 21 has a sharp cutting edge and a crescent shaped cross-sectional configuration as shown in FIG. 14.

The base 16 is an elongated structure about 8 inches in length and about 4 inches in width. The base 16 has a structure comprised of a front end 22, a rear end 24, and a flat bottom surface 26 shown in FIGS. 2 and 4-6. The base 16 is a longitudinally elongated body having a top 30 and a bottom 32. The rear end 24 of the base 16 has a hollow configuration and defines a longitudinally oriented carriage cavity 28 formed generally in the shape of a rectangular prism. The carriage cavity 28 is open both at the top 30 and at the bottom 32. The structure of the body of the base 16 defines longitudinally oriented, mutually parallel sides 34 and 36 which are sidewalls oriented perpendicular to the flat bottom 32 and between which the carriage cavity 28 is located.

A pair of elongated slots 38 and 40 are defined respectively in the sides 34 and 36. The slots 38 and 40 are closed at both their front end extremities 42 and at their rear end extremities 44. The slots 38 and 40 are linear and are inclined at an angle of between about 1° and about 15° extending forwardly and upwardly toward the front end 22 of the base 16 so that the rear ends 44 of the slots 38 and 40 lie closer to the bottom surface 26 of the base 16 than do the front end or end extremities 42 of the slots 38 and 40. The slots 38 and 40 are formed completely through the sides 34 and 36 and serve as linear ramps along which the carriage 18 moves. Preferably, the slots 38 and 40 are oriented at an inclination of about 8° relative to the flat bottom surface 26 of the base 16.

Together the slots 38 and 40 form a pair of longitudinally oriented, mutually parallel tracks on opposing sides of the carriage cavity 28. The front end extremities 42 form front limiting elements or abutments while the rear end extremities 44 form rear limiting elements or abutments for the tracks formed by the slots 38 and 40.

The carriage 18 is a block like structure having a pair of front wheels 46 mounted in coaxial alignment with each other at the front end of the carriage 18 and a pair of rear wheels 48 mounted in coaxial alignment with each other behind the front wheels 46. The wheels 46 and 48 rotate as the carriage 18 is moved from the rear end extremities 44 toward the front end extremities 42 of the slots 38 and 40. The wheels 46 and 48 allow the carriage 18 to travel smoothly along the tracks formed by the slots 38 and 40.

Figure 2:
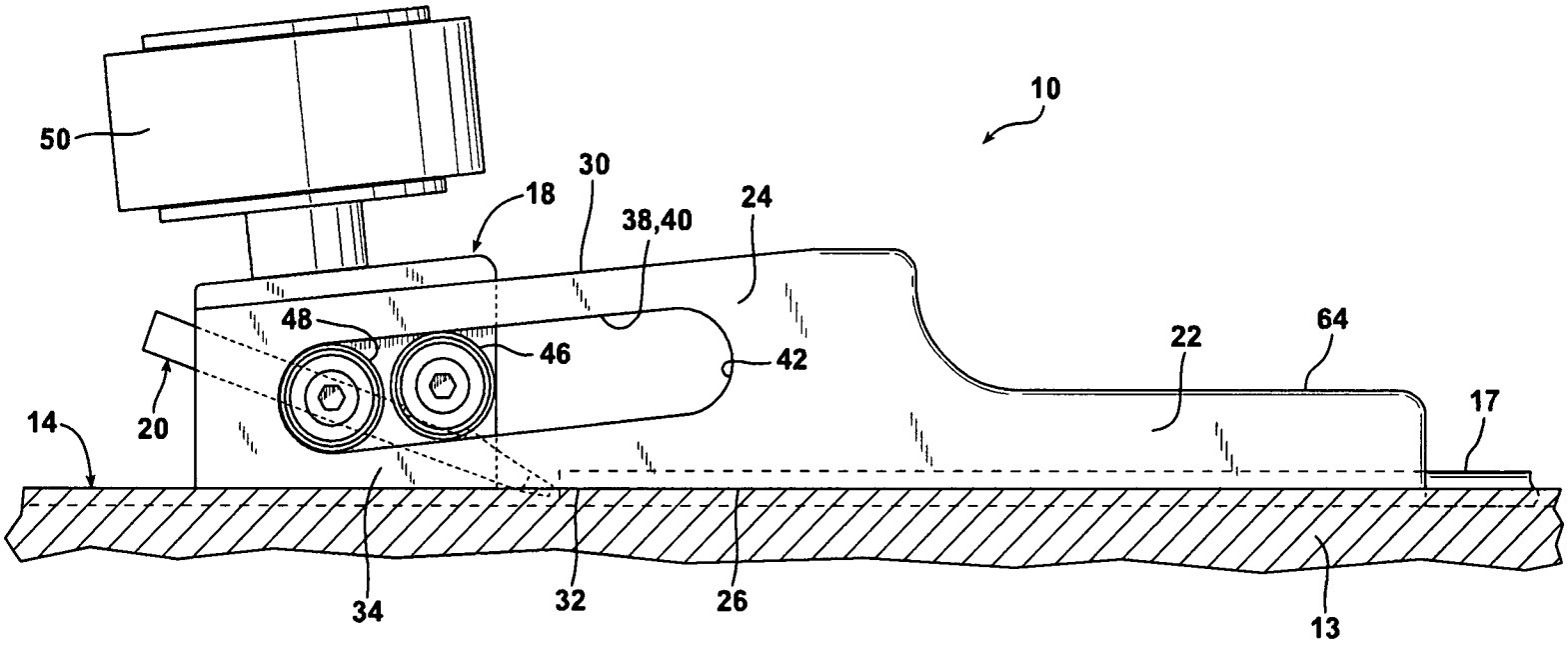
FIG. 2 is a side elevational view of the embodiment of the invention shown in FIG. 1 illustrating the carriage in the extreme rearward position.
Figure 4:
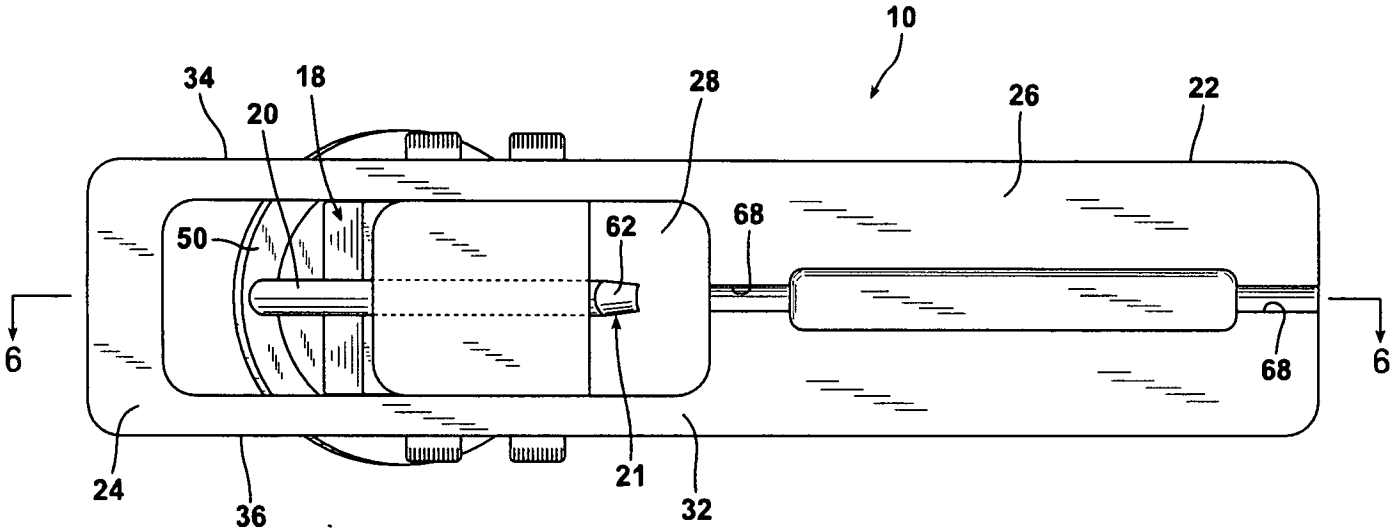
FIG. 4 is a bottom plan view of the embodiment of FIG. 1 shown with the blade carriage in the extreme forward position.
Figure 5:
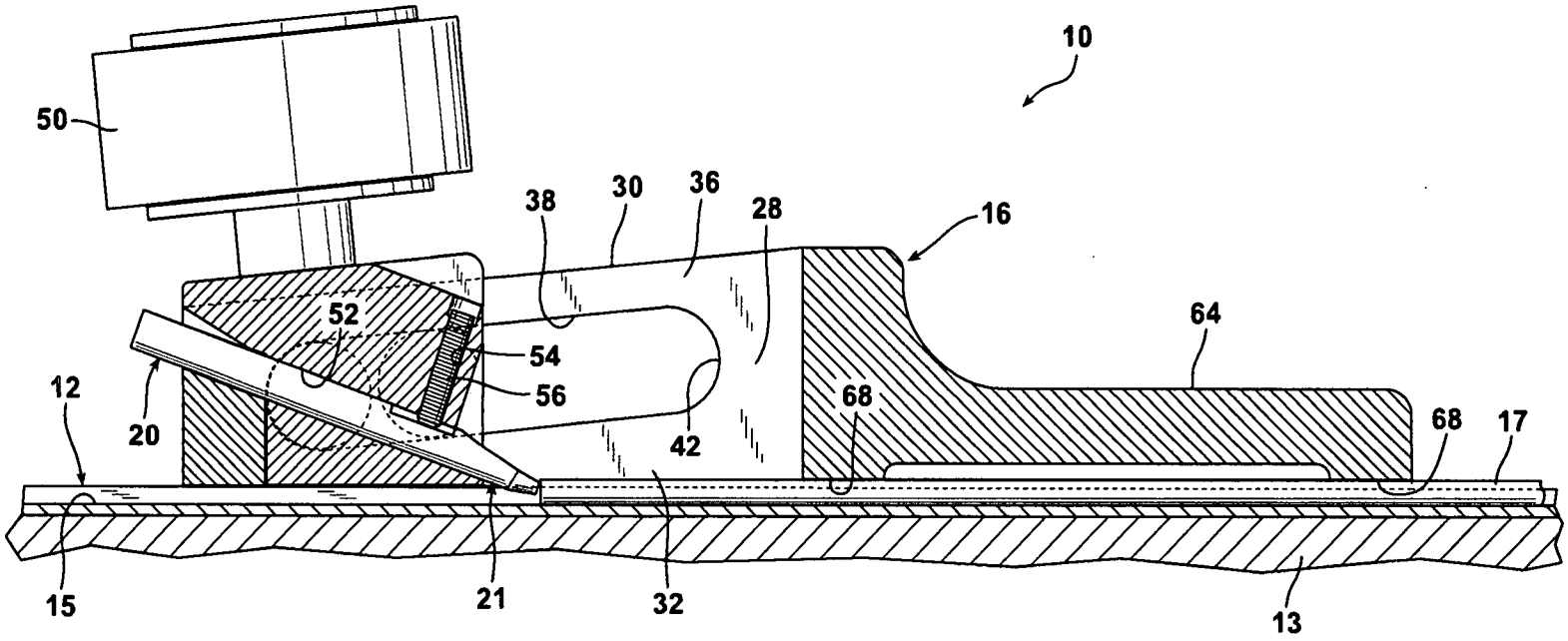
FIG. 5 is a side sectional view taken along the lines 5-5 in FIG. 3 showing the carriage in the extreme rearward position.
Figure 6:
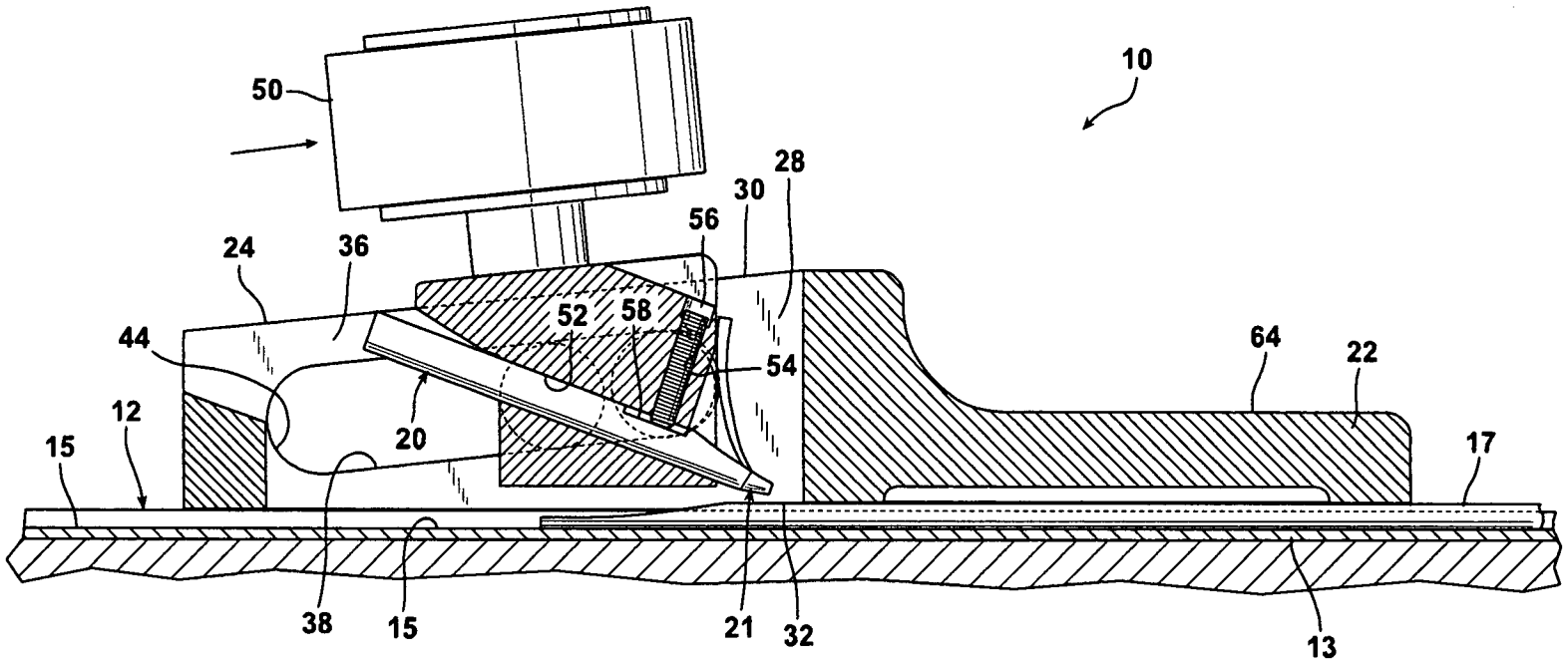
FIG. 6 is a side sectional view taken along the lines 6-6 in FIG. 4 showing the carriage in the extreme forward position.

The carriage 18 is mounted in the cavity 28 to travel with reciprocal movement along the tracks formed by the slots 38 and 40 between an extreme rearward position, as illustrated in FIGS. 2 and 5, and an extreme forward position, as illustrated in FIGS. 4 and 6. These extreme forward and rearward positions are determined respectively by the fore and aft limiting elements formed by the closed front extremities 42 and the closed rear extremities 44 of the slots 38 and 40. The front extremities 42 and the rear extremities 44 define limiting abutments in the inclined slots 38 and 40.

The carriage 18 serves as a blade carrier for the blade 20 and is provided with a generally drum shaped handgrip 50 that projects upwardly from the block shaped carriage 18. The structure of the carriage 18 is formed with an elongated, generally cylindrical shaped channel 52 that is configured to receive the blade 20. The channel 52 is parallel to the longitudinally extending sides 34 and 36 of the rear end 24 of the base 16. The channel 52 is inclined at an angle relative to the flat bottom surface 26 of the base 16 so that the channel 52 slopes upwardly and rearwardly relative to the front end 22 of the structure of the base 16, preferably at an angle of about 17° relative to the flat bottom surface 26 of the base 16.

The carriage 18 is also configured with an internally tapped setscrew bore 54 oriented perpendicular to and intersecting the channel 52. The setscrew bore 54 receives a set screw 56 which is threadably engaged therein. The setscrew 56 engaged in the internally threaded bore 54 thereby serves as a releasable blade lock mechanism on the blade carrier 18. When the setscrew 56 is loosened the blade 20 can be longitudinally advanced or retracted and positioned at different locations along the length of the channel 52. The setscrew 56 can be tightened within the internally tapped bore 54 to lock the blade 20 and prevent it from moving within the channel 52 so that the forwardly directed slicing tip 21 of the blade 20 can be locked in position to project from the blade carrier 18 different selected distances. The blade 20 is secured by the setscrew 56 at an inclination that extends upwardly and rearwardly relative to the front end 22 of the structure of the base 16.

Figure 13:
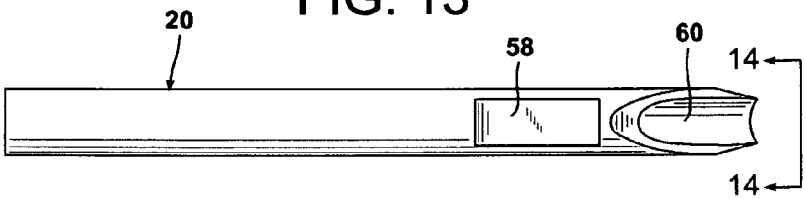
FIG. 13 is a top plan view of the blade of the embodiment of FIGS. 1-6 shown in isolation.

The blade 20 is illustrated in isolation in FIGS. 13 and 14. The blade 20 has a generally cylindrical shape throughout much of its length, but has a recessed, setscrew engaging flat 58 located just behind the narrow front slicing tip 21. The downwardly directed tip of the setscrew 56 is aligned in registration with the recessed flat 58 so that the extent of advancement and retraction of the slicing tip 21 within the channel 52 is limited by the longitudinal length of the setscrew engaging flat 58. The engagement of the setscrew 56 with the flat 58 provides a flat bearing surface for the setscrew 56 and also ensures that the blade 20 is releasably secured at a fixed rotational orientation relative to the blade carrier 18. That is, while the blade 20 can be advanced and retracted longitudinally within the channel 52, it cannot rotate within the channel 52. The concave surface 60 of the slicing tip 21 always faces directly upwardly toward the top 30 of the base 16. The constraint against rotation of the blade 20 by the engagement of the setscrew 56 with the recessed flat 58 ensures that the slicing tip 21 is always in the correct position of orientation relative to the flooring sheets 12 and 14.

Figure 3:
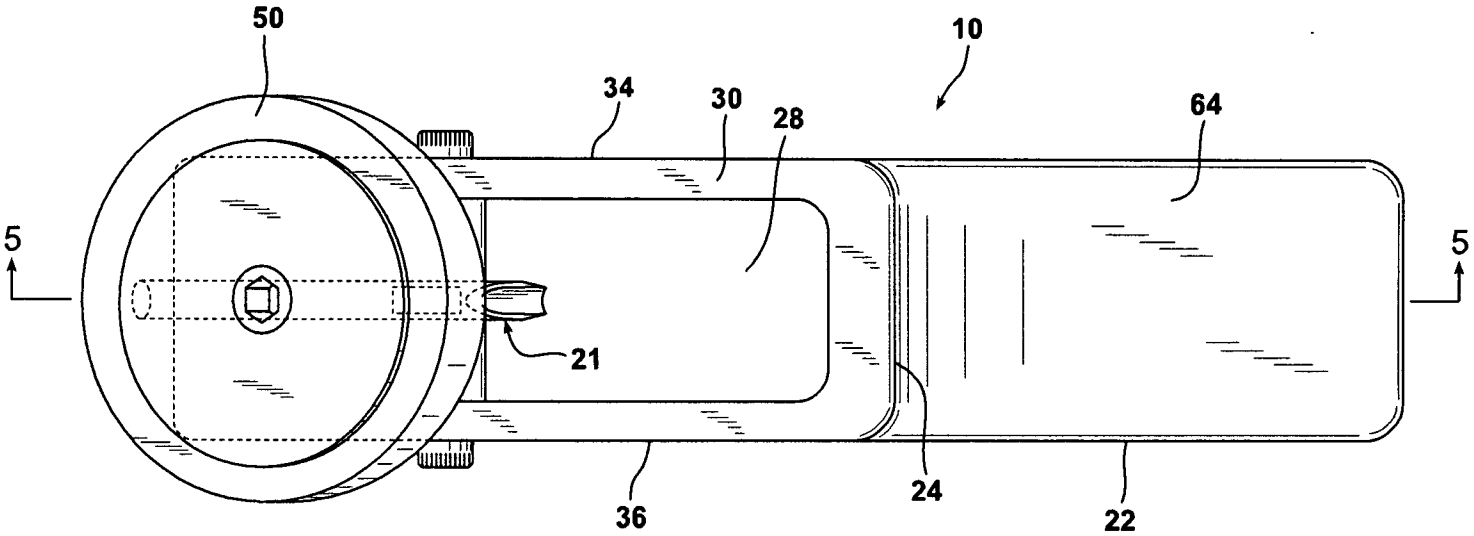
FIG. 3 is a top plan view of the embodiment of FIG. 1.

The blade 20 is releasably secured by the setscrew 56 so that the elevation of the narrow front cutting end 23 of the blade 20 is adjustable relative to the flat bottom surface 26 of the base 16. However, even when the blade 20 is moved to its rearmost position furthest to the rear of the carriage 18 as permitted by the projection of the setscrew 56 into the recessed flat 58, the lower, convex side 62 of the slicing tip 21 will always reside below the level of the flat surface 26 of the base 16, as illustrated in FIGS. 2, 3 and 5. Due to the inclination of the tracks formed by the slots 38 and 40, the lower convex side 62 of the forwardly directed slicing tip 21 is always located above the flat bottom surface 26 of the structure of the base 16 when the blade carriage or carrier 18 is at the extreme forward position illustrated in FIGS. 4 and 6

The front cutting end 23 of the slicing tip 21 has a crescent shaped cross-section as best illustrated in FIG. 14. The concave side 60 of the slicing tip 21 faces upwardly toward the open top 30 of the hollow rear end 24 of the base or body structure 16. The convex side 62 of the cutting tip 21 faces downwardly, in the opposite direction. The slicing tip 21 of the blade 20 increases in cross-sectional area in a direction increasing with distance from the front end 22 of the base or body structure 16. This configuration is best illustrated in FIGS. 4, 13 and 14. That is, the slicing tip 21 increases in cross-sectional area from the smallest area at the cutting and 23 to the largest area immediately adjacent to the recessed flat 58.

The front end 22 of the structure of the base 16 has a flat, upwardly facing surface 64 that is at least about 4 inches in length. A downwardly facing groove 68 of semicircular cross-section is defined in the flat bottom surface 26 of the body structure forming the base 16 and is visible in FIG. 4. The groove 68 is in longitudinal alignment with the front slicing tip 21 of the blade 20. The purpose of the semicircular groove 68 is to allow the flat bottom surface 26 of the base 16 to reside in intimate face-to-face contact with the flooring sheets 12 and 14 despite the initial upward projection of the bead 17 of sealant above the plane of the flooring sheets 12 and 14.

As each stick of sealant is used up, the bead of sealant 17 comes to an abrupt end in the groove 15. To ensure a firm and nearly invisible splice with the next stick of sealant, the tool 10 of the invention is positioned as illustrated in FIG. 1 with the groove 68 of the front end 22 of the tool base 16 positioned over the sealant bead 17 and the rear end 24 of the base 16 positioned over a portion of the groove 15 that has not yet been filled with sealant 17. The flat bottom surface 26 of the base 16 resides in face-to-face contact with the floor, half on the surface of the sheet 12 and the other half on the surface of the sheet 14. The base 16 is positioned so that the carriage 18 is in its rearmost position with the rear wheels 48 pushed back against the rear limiting extremities 44 of the slots 38 and 40 and with the slicing tip 21 of the blade 20 located just behind the abrupt end of the bead of sealant 17. The tool operator presses downwardly with one hand on the flat upper surface 64 of the front and 22 of the base 16 to ensure that the base 16 is held immobile and firmly against the sheets of flooring 12 and 14.

The flooring installer then pushes the carriage 18 forwardly and upwardly, up the ramps formed by the slots 38 and 40. This is done by gripping the handgrip 50 with the other hand and pushing it toward the front end 22 of the base 16. Since the handgrip 50 is secured to the carriage 18, the carriage 18 is forced up the inclined tracks formed by the slots 38 and 40 in the sides 34 and 36 of the rear end 24 of the base 16.

Figure 7:
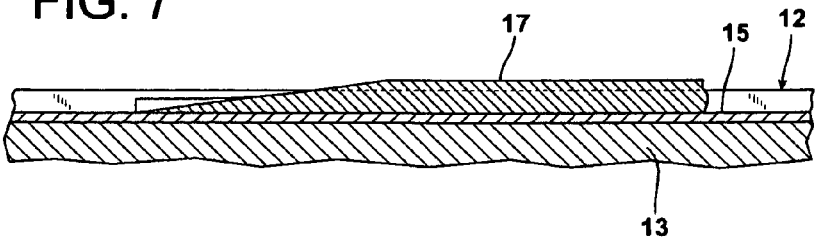
FIG. 7 is a side sectional detail showing an end of a bead of adhesive lying in a groove between two adjacent sheets of flooring following movement of the carriage from the position shown in FIGS. 2 and 5 to the position shown in FIGS. 4 and 6.
Figure 8:
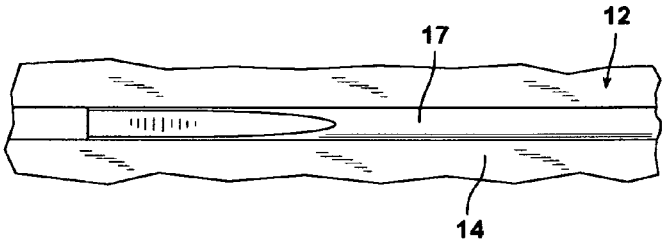
FIG. 8 is a top plan detail of FIG. 7.

The slicing tip 21 thereupon cuts into the end of the bead of sealant 17 near the bottom of the groove 15 and slices that end of the sealant bead 17 off at an upwardly rising incline until the front wheels 46 of carriage 18 meet the abutment formed by the closed front ends 42 of the slots 38 and 40. At this point the cutting tip 21 is above both the flat upper surfaces of the sheets of flooring 12 and 14 and also above the upwardly projecting portion of the sealant bead 17 protruding above the sheets of flooring 12 and 14. The sliced end of the sealant bead 17 thereupon appears as illustrated in FIGS. 7 and 8. Due to the shape of the cutting tip 21 and the sealant bead 17 the sliced flat, upwardly facing end surface of the sealant bead 17 has a steep parabolic shape, as illustrated in FIGS. 7 and 8.

Figure 10:
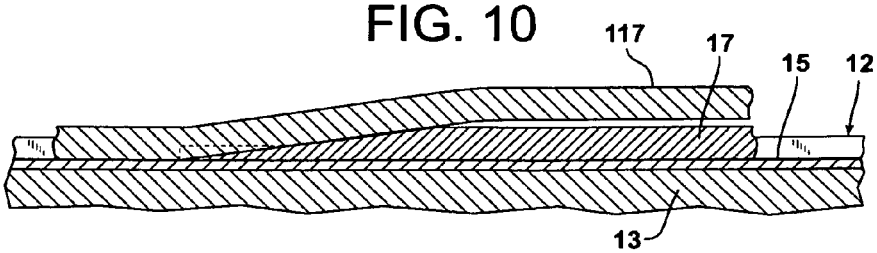
FIG. 10 is a longitudinal sectional detail showing ends of two sections of adhesive beads joined together in a splice.

The installer then proceeds to lay down the next bead of sealant 117 over the top of the sliced end of the sealant bead 17 using a heat welding gun. The relatively great surface areas of mutual contact of the sealant bead 17 and 117 provide a firm bond, since the second bead 117 is laid down in a melted state onto the first sealant bead 17. The second bead 117 melts onto the sliced end of the first bead 17 and appears as illustrated in FIG. 10 when first laid down.

Once the sealant beads 17 and 117, and all subsequent linearly aligned beads of sealant have been laid down into the groove 15, the upwardly projecting portions of the sealant beads are removed with a conventional skiving knife using a conventional skiving technique. Following the skiving operation the sealant beads 17 and 117 no longer project above the surfaces of the flooring sheets 12 and 14, but rather form a continuous adhesive filled seam in the sheets of flooring 12 and 14, as illustrated in FIGS. 11 and 12.

Figure 11:
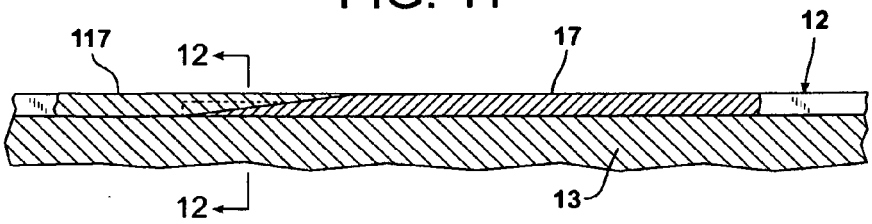
FIG. 11 is a longitudinal sectional detail showing ends of sections of adhesive beads joined together in a splice after removal of the upper portions of the bead sections following a skiving operation.
Figure 12:
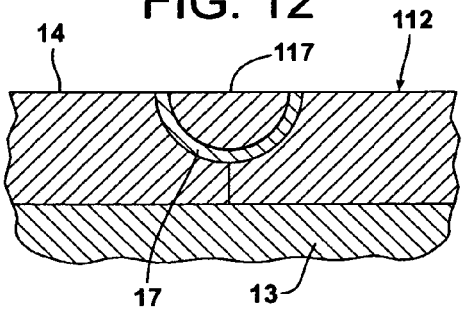
FIG. 12 is a cross-sectional detail taken along the lines 12-12 in FIG. 11 showing the two bead ends spliced together.

The use of the tool 10 ensures that the splice in the sealant beads illustrated in FIGS. 11 and 12 is nearly invisible to ordinary observation from above. Furthermore, the use of the tool 10 of the invention allows a user to very quickly prepare the terminal end of the bead of sealant 17 to receive a longitudinally overlapping subsequent bead of sealant 117. Unlike prior techniques for tapering the end of a sealant bead 17 in the groove 15, the tool 10 requires no great skill to use. Using the tool 10 to slice the ends of the sealant beads 17 ensures that the edges of the flooring sheets 12 and 14 are not damaged during the tapering of the bead ends. The angle of the incline of the slots 38 and 40 determines the incline of taper of the bead ends. That is, the angle will be the same so that the bead ends are preferably tapered at an angle relative to the flat bottom surface 26 of no greater than about 8°.

Undoubtedly, numerous variations and modifications of the invention will become readily apparent to those familiar with the installation of sheets of flooring. Accordingly, the scope of the invention should not be construed as limited to this specific embodiment depicted and described, but rather is defined in the claims appended hereto.

I claim:

1. A floor splicing tool for use in joining adjacent sheets of flooring together comprising:

a body structure with a flat bottom surface and formed with front and rear ends, wherein said rear end is hollow with an open top and an open bottom and has longitudinally oriented, mutually parallel sides oriented perpendicular to said flat bottom surface, a pair of longitudinally oriented, mutually parallel tracks with both fore and aft limiting elements defined in said sides and said tracks are inclined upwardly and forwardly toward said front end of said body, between said limiting elements, and said tracks are formed as inclined slots in said rear end of said structure and which have closed front and rear extremities, and said slots are oriented and an inclination of between about 1° and about 15° relative to said flat bottom surface of said body structure, and said closed front and rear extremities of said slots form said limiting elements, a blade carrier mounted on said body structure between said mutually parallel sides for reciprocal movement along said tracks between extreme forward and extreme rearward positions as determined respectively by said fore and aft limiting elements, a handgrip secured to said blade carrier and projecting upwardly therefrom and said handgrip is freely movable relative to said base so that said blade carrier moves together with said handgrip freely along said inclined slots as controlled by the fore and aft position of said handgrip relative to said body structure, and a blade secured to said blade carrier and having a narrow front slicing tip, wherein said blade is directed toward said front end of said body structure, and is carried by said blade carrier with said front slicing tip changing in elevation relative to said flat bottom surface of said body structure depending upon the position of said blade carrier on said tracks, and when said blade carrier is in said extreme rearward position said blade tip resides beneath said flat bottom surface of said body structure and when said blade carrier is in said extreme forward position said blade tip resides above said flat bottom surface of said body structure.

2. A floor splicing tool according to claim 1 wherein said tracks are formed as inclined ramps at said rear end of said structure and said fore and aft limiting elements are formed as abutments at opposing longitudinal extremities of said tracks.

3. A floor splicing tool according to claim 2 wherein said ramps are linear and slope upwardly and forwardly at an angle of about 8° relative to said flat bottom surface.

4. A floor splicing tool according to claim 1 wherein said blade is releasably secured at a fixed rotational orientation relative to said blade carrier.

5. A floor splicing tool according to claim 4 wherein said narrow front slicing tip of said blade has a crescent shaped cross-section, the concave side of which faces upwardly, towards said open top of said hollow rear end of said body structure.

6. A floor splicing tool according to claim 5 wherein said crescent shaped cross-section of said narrow front slicing tip of said blade increases in cross-sectional area in a direction increasing with distance from said front end of said body structure.

7. A floor splicing tool according to claim 6 in which a downwardly facing groove of semicircular cross-section is defined in said flat bottom surface of said body structure and in longitudinal alignment with said front slicing tip of said blade.

8. A floor splicing tool comprising:

an elongated body having a structure defining a flat bottom surface, a front end and a rear end, and said rear end of said structure has a longitudinally elongated cavity defined therein and said structure of said body has a top and a bottom, both of which are open at said cavity at said rear end of said structure, and said structure has longitudinally extending sides at said rear end thereof oriented perpendicular to said flat bottom surface between which said cavity is located, a pair of parallel tracks with longitudinal limits formed on said sides of said rear end, and said tracks extend longitudinally upwardly and forwardly at an inclination relative to said flat bottom surface of said structure towards said front end of said structure between said longitudinal limits, and said tracks are formed as inclined slots in said rear end of said structure and which have closed front and rear extremities, and said slots are oriented and an inclination of between about 1° and about 15° relative to said flat bottom surface of said elongated body, and said closed front and rear extremities of said slots form said longitudinal limits, a blade carrier mounted in said cavity of said rear end of said structure for reciprocal movement along said tracks between extreme rearward and extreme forward positions defined by said longitudinal limits, a handgrip secured to said blade carrier and projecting upwardly therefrom and said handgrip is freely movable relative to said base so that said blade carrier moves together with said handgrip freely along said inclined slots as controlled by the fore and aft position of said handgrip relative to said body structure, and a blade secured to said blade carrier and having a forwardly directed slicing tip and said blade is directed toward said front end of said body structure, whereby said blade is carried by said blade carrier with said front slicing tip changing in elevation relative to said flat bottom surface of said body structure depending upon the position of said blade carrier on said tracks, so that said slicing tip is located beneath said flat bottom surface of said structure when said blade carrier is at said extreme rearward position and above said flat bottom surface of said structure when said blade carrier is at said extreme forward position.

9. A floor splicing tool according to claim 8 wherein said tracks are oriented at an inclination of about 8° relative to said flat bottom surface.

10. A floor laying tool according to claim 8 wherein said front end of said structure has a flat upwardly facing surface and is at least about four inches in length said.

11. A floor splicing tool according to claim 8 wherein said blade carrier is provided with an elongated channel configured to receive said blade, and said channel is parallel to said longitudinally extending sides of said rear end and is inclined at an angle relative to said flat bottom surface so that said channel slopes upwardly and rearwardly relative to said front end of said structure.

12. A floor splicing tool according to claim 11 further comprising a releasable blade lock mechanism on said blade carrier wherein said blade can be positioned at different locations along the length of said channel and locked so that said forwardly directed slicing tip projects from said blade carrier different selected distances.

* * * * *